US005430253A

United States Patent [19]

Pratt

[11] Patent Number: 5,430,253

[45] Date of Patent: Jul. 4, 1995

[54] ELECTRICAL OUTLET COVER ASSEMBLY

[75] Inventor: Michael L. Pratt, Memphis, Tenn.

[73] Assignee: Thomas & Betts Corporation, Memphis, Tenn.

[21] Appl. No.: 968,560

[22] Filed: Oct. 29, 1992

[51] Int. Cl.[6] ..... H01R 13/447

[52] U.S. Cl. ..... 174/67; 16/257; 16/293; 16/296; 267/165

[58] Field of Search ..... 174/67; 220/242; 439/142; 267/158, 164, 165; 16/257, 293, 296

[56] References Cited

U.S. PATENT DOCUMENTS

| | | | |
|---|---|---|---|
| 2,644,063 | 6/1953 | Zikmund et al. | 267/158 X |
| 2,870,933 | 1/1959 | Winter | 220/24.3 |
| 2,985,334 | 5/1961 | Slater | 220/24.3 |
| 2,987,214 | 6/1961 | Radak | 220/243 |
| 3,140,344 | 7/1964 | Slater et al. | 174/67 |
| 3,189,212 | 6/1965 | Bellek | 220/24.3 |
| 3,204,807 | 9/1965 | Ramsing | 220/24.3 |
| 3,252,611 | 5/1966 | Weitzman et al. | 220/24.3 |
| 3,936,907 | 2/1976 | Jansons | 16/257 |
| 4,134,516 | 1/1979 | Sullo | 220/242 |
| 4,342,493 | 8/1982 | Grenell | 339/44 M |
| 4,381,063 | 4/1983 | Leong | 220/242 |
| 4,456,145 | 6/1984 | Frank | 439/142 X |
| 4,505,403 | 3/1985 | Bowden et al. | 220/242 |

FOREIGN PATENT DOCUMENTS

| | | | |
|---|---|---|---|
| 1551827 | 9/1979 | United Kingdom | 16/257 |

*Primary Examiner*—Leo P. Picard
*Assistant Examiner*—David Tone
*Attorney, Agent, or Firm*—Thomas & Betts Corp.

[57] ABSTRACT

A hinged electrical outlet cover biased rotatably about the hinge axis by an M-shaped spring. In one arrangement, the cover is self-closing throughout its entire range of movement between fully open and fully closed positions. In another arrangement, the cover is positively held open in its fully open position and is self-closing over a limited range of movement from its fully closed position to an intermediate open position. The cover and a support member on which it is hinged are designed for quick snap assembly without requiring the use of special tools or separate fasteners.

39 Claims, 6 Drawing Sheets

ELECTRICAL OUTLET COVER ASSEMBLY

FIELD OF THE INVENTION

This application relates to the art of hinged covers and, more particularly, to such covers that are spring biased rotatably about the hinge axis. The invention is particularly applicable to covers for electrical outlets and will be described with specific reference thereto. However, it will be appreciated that features of the invention may have broader aspects and can be used in other environments.

BACKGROUND OF THE INVENTION

Outdoor electrical outlets are mounted in weatherproof boxes and a gasketed cover plate is attached over the box opening. The cover plate has openings through which electrical outlets are accessible, and gasketed hinged covers engage the cover plate around the openings therein to inhibit ingress of moisture.

In arrangements of the type described, the hinged cover rotates approximately 90° between its fully closed and fully open positions. One type of assembly has a cover that is constantly spring-biased toward its fully closed position. The cover must be held open manually while a plug is inserted in an outlet and the cover is then held open by the plug. Removal of the plug causes the cover automatically to return to its fully closed position. In other arrangements, the cover is positively held open by a spring in the fully open position of the cover. Manual force must be applied to the cover for starting movement of same toward its fully closed position until a spring takes over and biases the cover closed.

Cover assemblies of the type described must be reliable in operation despite exposure to extreme weather conditions for many years. It is also desirable that such cover assemblies be economical and simple to manufacture and assemble.

SUMMARY OF THE INVENTION

A cover assembly of the type described is spring biased rotatably about a hinge axis by a generally M-shaped spring. The spring has a pair of inclined legs that converge toward a generally V-shaped spring central portion and intersect same at arcuate bends. The spring engages a cam on the cover along the arcuate bends.

The spring has leg free end portions that are bent upwardly at leg end arcuate bends. Longitudinal slots are provided in the leg end arcuate bends for receiving elongated projections on a support member. Cooperation between the slots and raised projections allows longitudinal sliding movement of the leg end arcuate bends along the support member while preventing lateral displacement of the spring therefrom.

The support member is generally U-shaped and includes a base having a pair of legs extending therefrom. The base has a central rivet hole for receiving a rivet to secure the support member to a box cover plate. Additional holes in the base adjacent the legs receive projections on the box cover plate to prevent rotation of the support member about the rivet.

The legs of the support member include first leg portions that extend outwardly from the base and are reversely curved to define second leg portions extending back toward the base in spaced relationship to the first leg portions. Openings in the second leg portions rotatably receive pintles on a cover to provide a hinge connection between the cover and the support member.

The cover pintles have bottom cam surfaces to facilitate outward movement of the support member legs as a cover is forced therebetween until the pintles snap into the leg openings. The leg openings have portions that are larger than the pintles to facilitate movement of the pintles into the openings. Once the pintles are in the openings, the cover is biased outwardly to engage the pintle outer surfaces with opening peripheral portions that have substantially the same curvature as the pintles.

A cam member on the cover cooperates with the spring and may be shaped to provide constant biasing of the cover to its closed position, or may be shaped to provide such biasing over a limited arc while positively holding the cover in its fully open position.

It is a principal object of the present invention to provide an improved cover assembly for electrical outlets.

It is also an object of the invention to provide an improved arrangement for spring biasing a cover rotatably about a hinge axis.

It is a further object of the invention to provide an improved spring and cover support member.

It is an additional object of the invention to provide an improved hinged cover.

DETAILED DESCRIPTION OF THE PREFERRED EMBODIMENT

Figure 1:
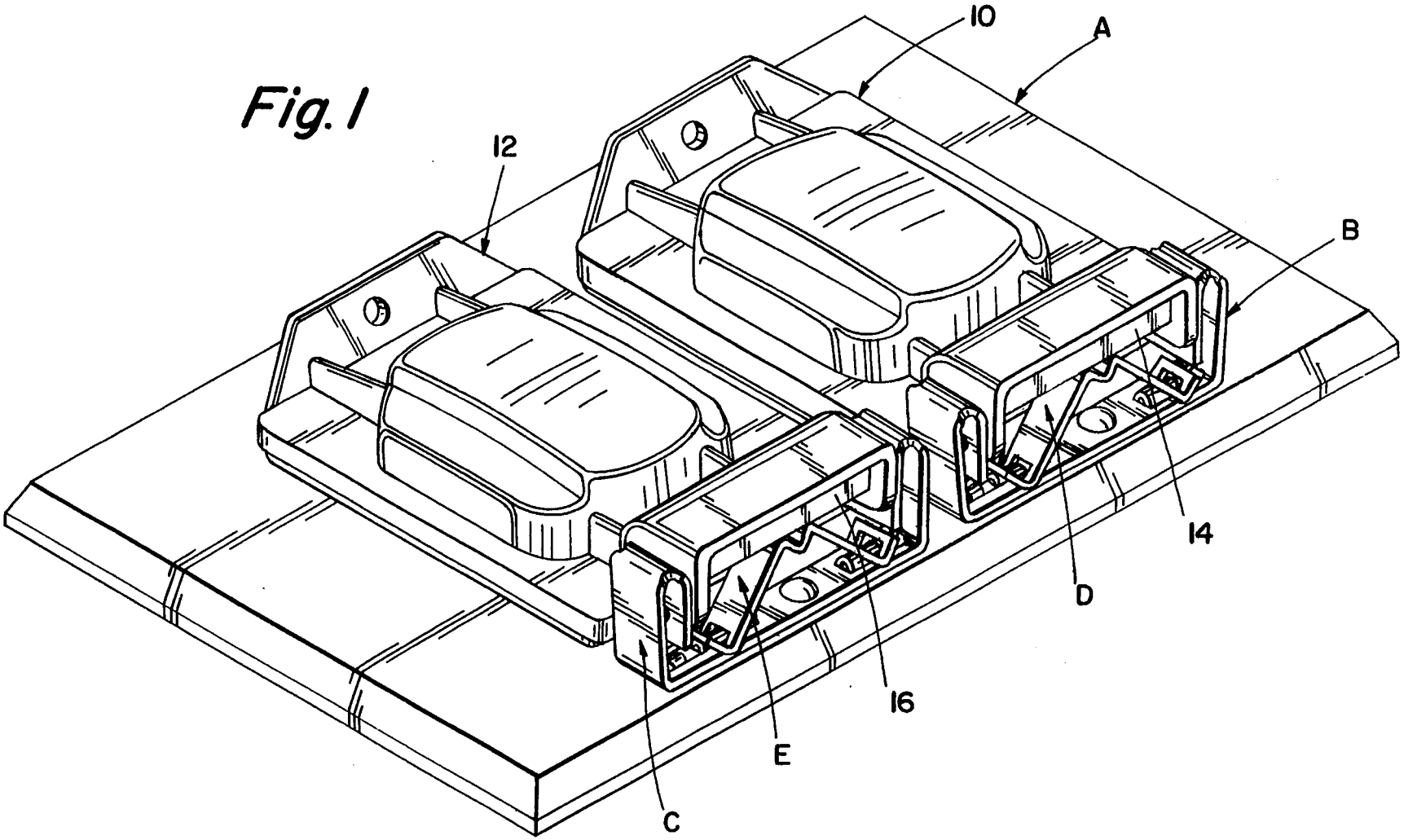
FIG. 1 is a perspective illustration of an improved electrical outlet cover assembly constructed in accordance with the present invention.

Referring now to the drawing figures, wherein the showings are for purposes of illustrating a preferred embodiment of the invention only and not for purposes of limiting same, FIG. 1 shows a box cover plate A having covers 10, 12 hinged thereto on support members B, C. Generally M-shaped leaf springs D, E of spring temper stainless steel cooperate with cams 14, 16 on covers 10, 12 for biasing such covers rotatably about the hinge axis.

Figure 2:
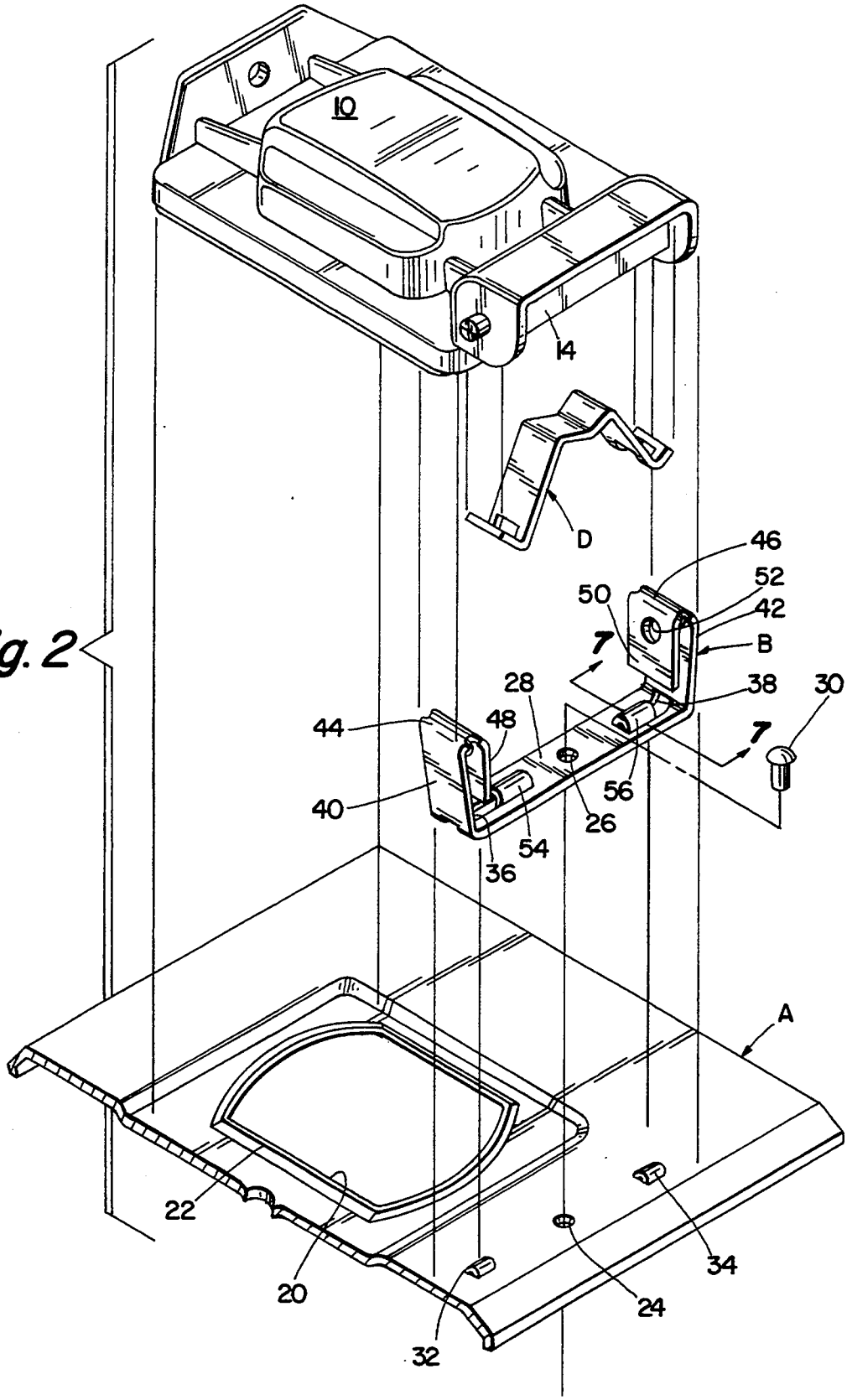
FIG. 2 is a partial exploded perspective illustration of a cover assembly constructed in accordance with the present invention.
Figure 3:
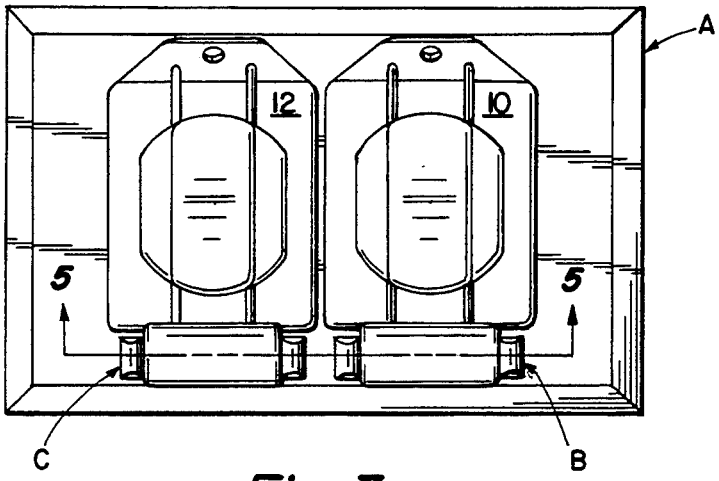
FIG. 3 is a top plan view of the cover assembly.
Figure 4:
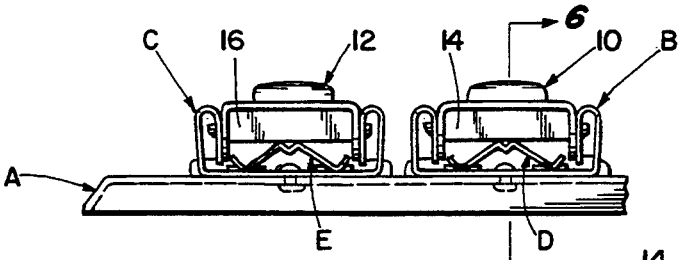
FIG. 4 is a side elevational view thereof.

As shown in FIG. 2, box cover plate A has openings therein, only one of which is shown at 20, for providing access to an electrical outlet. A raised periphery 22 is provided around opening 20 for engagement by a suitable gasket carried by cover 10 in a known manner. Cover plate A has a hole 24 therethrough above opening 20 and being alignable with a central hole 26 in a base 28 on support member B of full hard stainless steel. Preferably, hole 24 is located slightly off center relative to opening 20 so as to prevent interference between covers during operation. A rivet 30 passes through holes 24, 26 to secure support member B to box cover plate A. Cover plate A is provided with raised projections 32, 34 receivable in additional holes 36, 38 in base 28 of support member B. This cooperation between projections 32, 34 and holes 36, 38 prevents relative rotation between support member B and box cover plate A about rivet 30. Box cover plate A and covers 10, 12 may be of metal or plastic.

Support member B has a pair of legs that include first leg portions 40, 42 extending outwardly from base 28 and being reversely curved as generally indicated at 44, 46 to define second leg portions 48, 50 extending back toward base 28 in inwardly-spaced relationship to first leg portions 40, 42. Each second leg portion 48, 50 has an opening therein for receiving a hinge pintle on a cover, and such an opening is shown at 52 in second leg portion 50. It will be understood that second leg portion 48 has a corresponding opening that is not visible in FIG. 2. The opposite sides of reversely curved portions 44, 46 are cut-away so they have a width less than the width of first and second leg portions 40, 42 and 48, 50. In other words, the reversely curved portions 44, 46 are weakened to facilitate bending thereof.

Base 28 of support member B has elongated raised projections 54, 56 thereon between rivet receiving hole 26 and additional holes 36, 38. These raised projections are for cooperation with slots in spring D. Numerals used to describe the cover assembly for cover 10 of FIG. 2 are used with the addition of a prime for the assembly of cover 12 in other figures.

Figure 5:
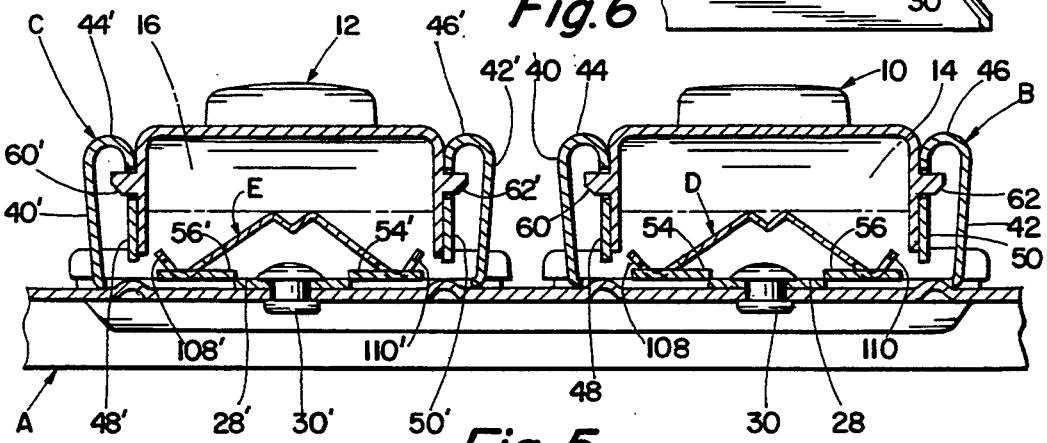
FIG. 5 is a partial cross-sectional elevational view taken generally on line 5—5 of FIG. 3.

FIG. 5 shows integral cover hinge pintles 60, 62 extending outwardly therefrom along a common hinge axis. The pintles are received in the openings provided in second leg portions 48, 50 of support member B. Springs D, E engage the cam projections 14, 16 on covers 10, 12 to bias same rotatably about the hinge axis. The legs of the springs are free to slide along base 28 on support member B as the height of the spring decreases and increases during opening and closing movement of a cover.

Figure 6:
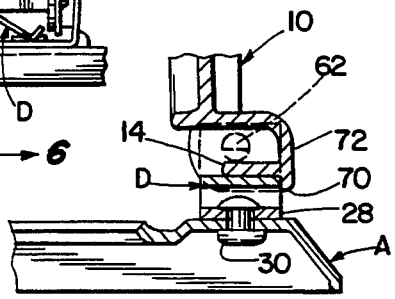
FIG. 6 is a partial cross-sectional elevational view showing a cover in its fully open position.

As best shown in FIG. 6, cover cam projection 14 is spaced inwardly from a rear end 70 of a cover top wall 72 on a mounting portion thereof. This provides an abutment that engages a side of spring D in the fully open position of cover 10 as shown in FIG. 6. This fully open position of the cover is approximately 90° from the fully closed position of the cover.

Figure 7:
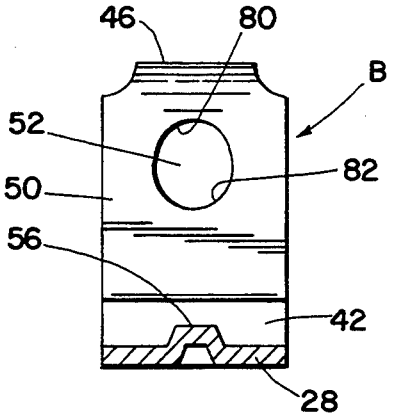
FIG. 7 is a cross-sectional elevational view taken generally on line 7—7 of FIG. 2.

Referring to FIG. 7, pintle receiving opening 52 in second leg portion 50 of support member B has an upper peripheral portion 80 that is curved at about the same curvature as the cylindrical pintles on the covers. In one arrangement, upper curved peripheral portion 80 lies on the periphery of a circle having a diameter of about 0.125 inch. The diameter of a cylindrical pintle 60, 62 on a cover 10, 12 is about 0.115 inch. The lower peripheral portion 82 of opening 50 lies on the periphery of a circle having a diameter of about 0.140 inches. Thus, the lower portion of opening 52 is substantially larger than the cross-sectional size of a cover hinge pintle. This makes it easier to enable assembly of the hinge pintles into the openings 52. Once the pintles are received in the openings, the springs D, E bias the cover outwardly away from the box cover plate so that the outer periphery of a hinge pintle is in firm engagement with an upper peripheral portion 80.

Figure 8:
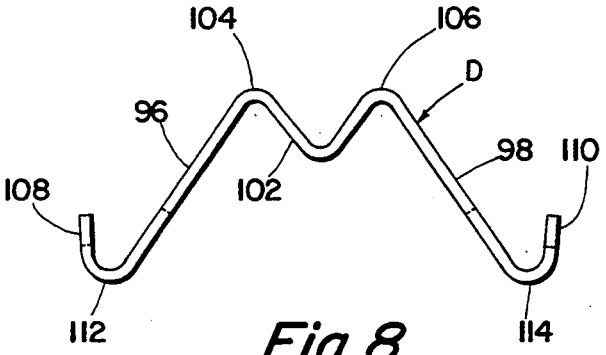
FIG. 8 is a side elevational view of the spring used in the cover assembly of the present invention.
Figure 9:
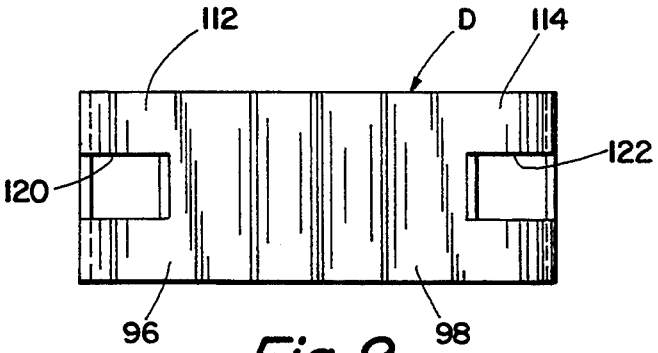
FIG. 9 is a bottom plan view of the spring of FIG. 8.
Figure 10:
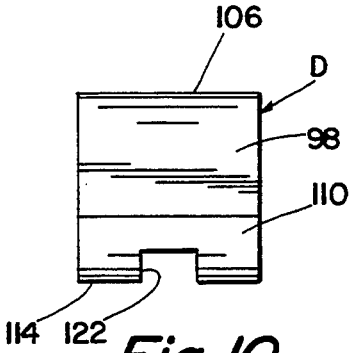
FIG. 10 is an end elevational view of the spring of FIG. 8.

Referring to FIGS. 8–10, spring D has a pair of opposite inclined legs 96, 98 that converge upwardly toward a spring central portion 102 that is generally V-shaped. Legs 96, 98 intersect the spring central portion 102 at arcuate bends 104, 106. It is the outer surfaces of these arcuate bends 104, 106 that engage a cam member 14, 16 on covers 10, 12. The cam members move laterally across the outer surfaces of arcuate-bends 104, 106 during opening and closing movement of a cover.

The free end portions of spring legs 96, 98 are bent upwardly as indicated at 108, 110 at lower leg bend portions 112, 114. The curved outer surfaces of lower leg bend portions 112, 114 engage base 28 on support member B and are free to slide longitudinally therealong during opening and closing movement of a cover. Referring back to FIG. 5, the length of upwardly extending spring end portions 108, 110 is such that the terminal ends thereof are located above the terminal ends of second leg portions 48, 50 on support member B. In other words, the space between the terminal ends of second leg portions 48, 50 and base 28 is smaller than the length of spring end portions 108, 110. This confines the spring in the space between second leg portions 48, 50. Referring back to FIGS. 8–10, central longitudinal slots 120, 122 are provided in lower leg bend portions 112, 114 for receiving the projections 54, 56 on support member B. This guides longitudinal movement of the spring on base 28 of support member B while preventing lateral displacement of the spring from its position on base 28.

Figure 11:
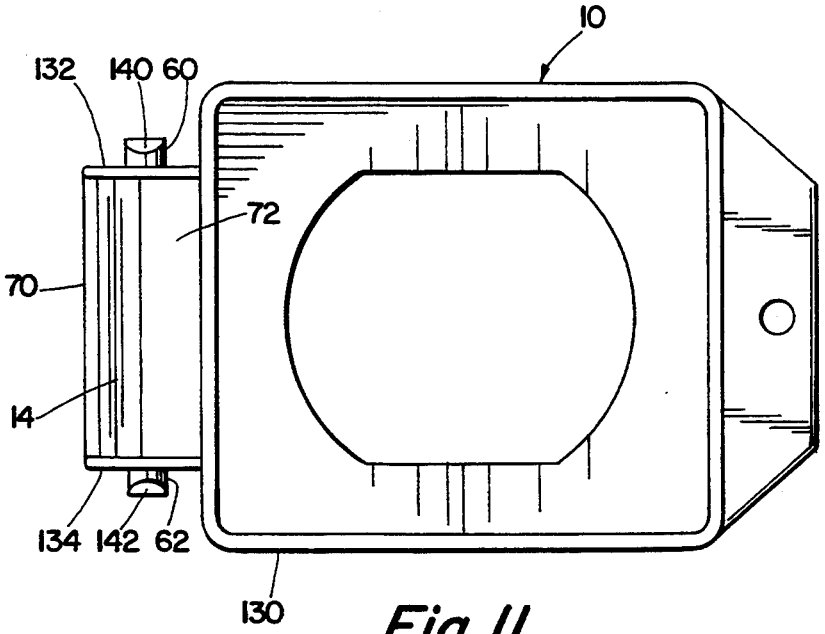
FIG. 11 is a bottom plan view of a cover constructed in accordance with the present invention.
Figure 12:
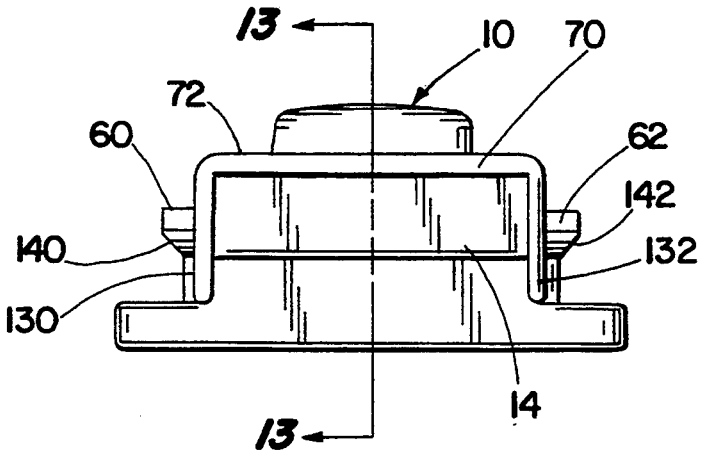
FIG. 12 is an end elevational view of the cover of FIG. 11.
Figure 13:
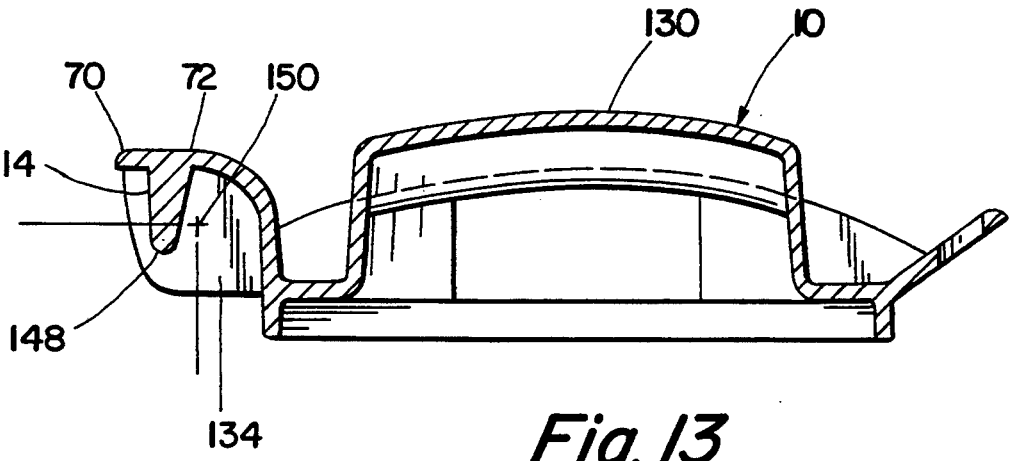
FIG. 13 is a cross-sectional elevational view taken generally on line 13—13 of FIG. 12.

Referring to FIGS. 11–13, cover 10 has a main body portion 130 and a rear tail or mounting portion that includes top wall 72 and opposite end walls 132, 134. Integral hinge pintles 60, 62 project outwardly from end walls 132, 134 along a common hinge pintle axis. The lower half of each hinge pintle 60, 62 slopes downwardly and inwardly as indicated at 140, 142 from the outer ends thereof. These sloping surfaces 140, 142 define cam surfaces that facilitate movement of a cover mounting portion between the legs of a support member. Sloping surfaces 140, 142 occupy less than the full length of pintles 60, 62 so that the portions of the pintles adjacent to cover end walls 132, 134 are cylindrical, and it is these cylindrical portions that engage the periphery of the openings in the legs of the support member.

Second leg portions 48, 50 of support member B are spaced-apart a distance that is about the same or slightly greater than the external distance between end walls 132, 134. The distance between second leg portions 48, 50 is substantially less than the distance between the outer terminal ends of hinge pintles 60, 62. To assemble a cover, the spring D is positioned on base 28 of support member B. Cover 10 is then moved into position for engaging pintle cam surfaces 140, 142 with second leg portions 48, 50 adjacent reversely curved portions 44, 46. Force is applied to the cover for camming the legs of support member B apart until the cover hinge pintles find the holes in second leg portions 48, 50.

The unstressed free height of a spring is substantially greater than the distance between the end of cam projection 14 and base 28 of support member B in the assembled position of cover 10. Therefore, assembly of the cover also reduces the height of the spring significantly so that it applies high biasing force on the cover cam projection.

FIG. 13 shows cover cam projection 14 having a rounded cam end portion 148 projecting downwardly below pintle hinge axis 150 and located a substantial distance to the left of such axis. Main body portion 130 of cover 10 is located on the opposite side of hinge pintle axis 150 from rounded cam end portion 148. Thus, as long as the point of engagement between the spring and rounded cam end portion 148 is on the opposite side of axis 150 from cover main body portion 130, the cover will be biased clockwise in FIG. 13 about hinge pintle axis 150.

The location and shape of cam projection 14 and its rounded cam end portion 148 in the cover of FIG. 13 are such that the cover is biased closed during movement thereof between its fully closed position and a partly open position defined by movement of the cover through an angle of at least 50° from its fully closed position. On the other side of such partly open position, the point of engagement between cam rounded end portion 148 and the spring moves to the right side of hinge axis 150 so that the cover is positively held in its fully open position.

Figure 14:
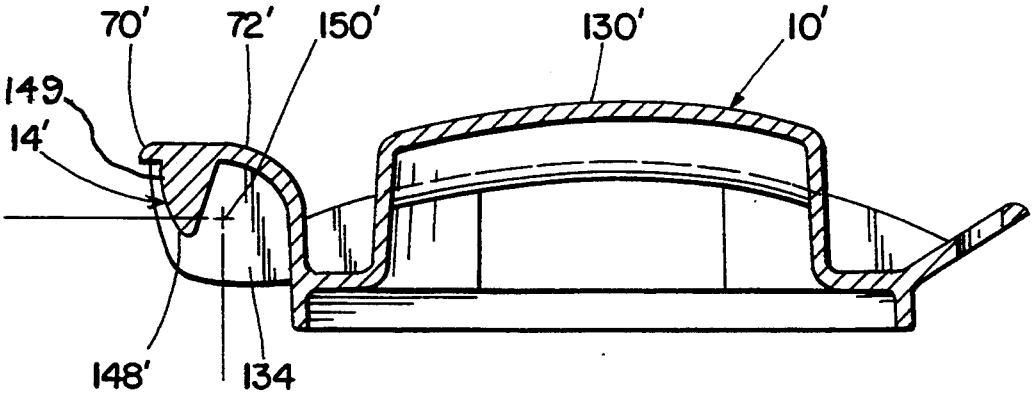
FIG. 14 is a view similar to FIG. 13 but showing a different type of cam for cooperating with the spring.

The cover of FIG. 14 differs slightly from the cover of FIG. 13 and corresponding parts bear corresponding numerals with the addition of a prime. Cam projection 14' and its rounded cam end portion 148' are shaped and positioned for constantly biasing cover 10' to its fully closed position during the entire range of movement thereof. Thus, the point of engagement between cam arcuate surface 149 or rounded end portion 148' and the spring always remains to the left of hinge axis 150'.

Figure 15:
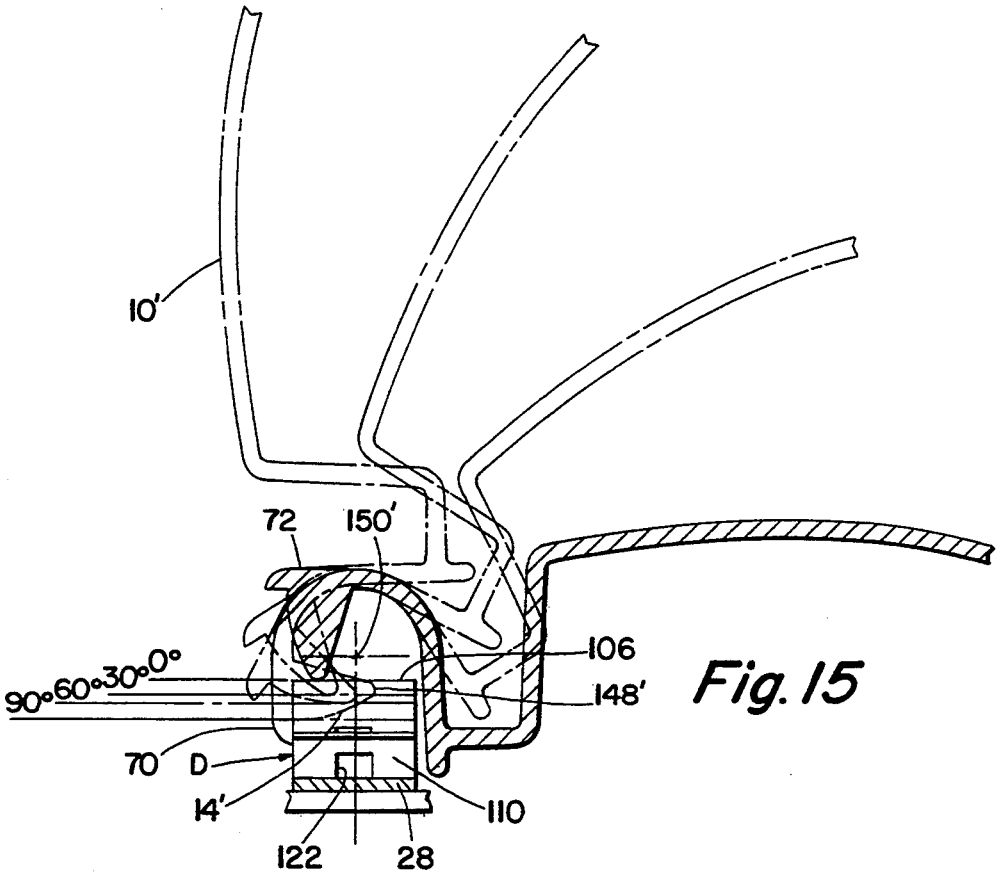
FIG. 15 is a diagrammatic side elevational view showing how the cam member on the cover of FIG. 14 cooperates with the spring.
Figure 16:
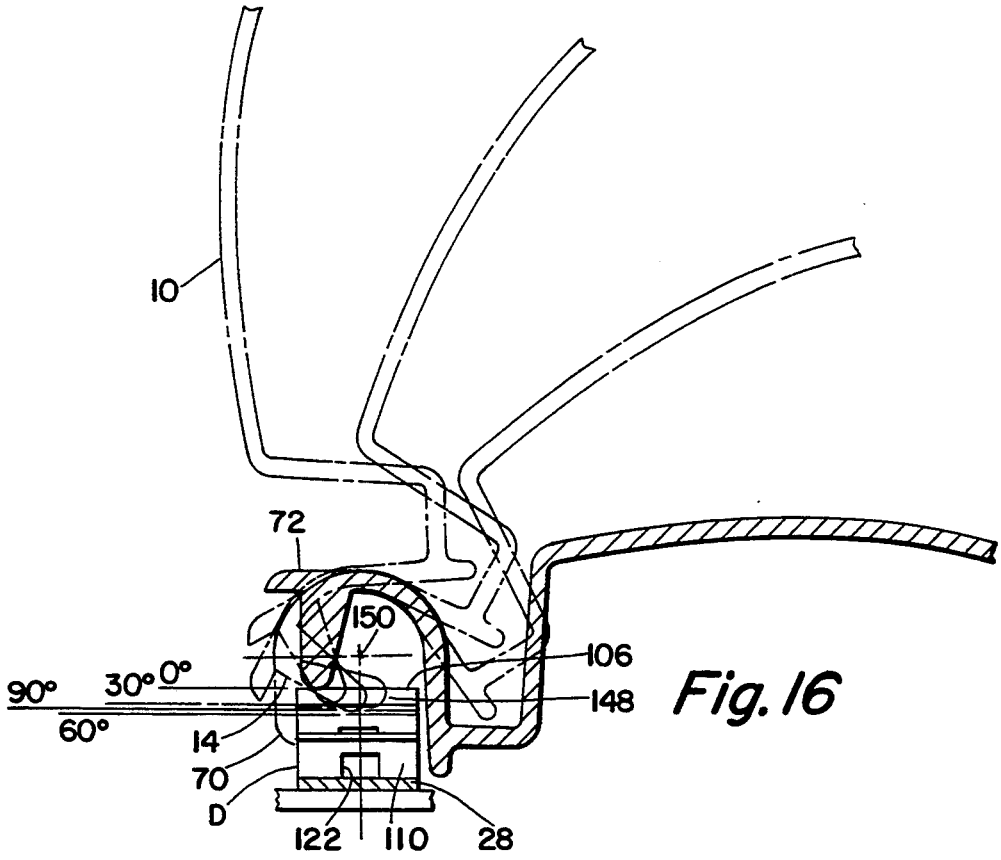
FIG. 16 is a view similar to FIG. 15 but showing how the cam on the cover of FIG. 13 cooperates with the spring.

FIGS. 15 and 16 show the location of the point of engagement between a cam projection and a spring relative to the hinge pintle axis at different degrees of cover rotation. Horizontal shadow lines show the location of the point of engagement between a spring and cam projection at 0, 30, 60 and 90 degrees of cover rotation. Zero degrees corresponds to a closed cover position, while 90° corresponds to a fully open position. As shown in FIG. 15, the point of engagement between the spring and cam projection is always located to the left of hinge pintle axis 150' so that the cover is always biased clockwise to its closed position.

In FIG. 16, the point of engagement between the spring and cam rounded end portion 148 is approximately on dead center below hinge axis 150 when the cover has rotated from its fully closed position through an angle of about 60° to a partly open position. Thus, the spring constantly biases the cover toward its closed position at any time the cover is within about 60° from its fully closed position. The cam projection is preferably designed such that this angle is greater than about 50°. Between the partly open 60° position and the fully open 90° position, the point of engagement between the spring and cam rounded end portion 148 is located to the right of hinge pintle axis 150 in FIG. 16 so that the cover is held and biased counterclockwise to its open position.

Although the invention has been shown and described with respect to a preferred embodiment, it should be appreciated that equivalent alterations and modifications will occur to others skilled in the art upon the reading and understanding of this specification. The present invention includes all such equivalent alterations and modifications, and is limited only by the scope of the claims, appended hereto.

I claim:

1. A hinged electrical outlet cover movable between open and closed positions, and a generally M-shaped leaf spring biasing said cover toward at least one of said positions.

2. The cover of claim 1 wherein said spring biases said cover toward said closed position.

3. The cover of claim 1 wherein said spring constantly biases said cover toward said closed position over the entire range of movement of said cover.

4. The cover of claim 1 wherein said cover has a fully open position and intermediate open positions, said spring biasing said cover toward said closed position over the range of movement of said cover between one of said intermediate open positions and said closed position, and said spring acting to hold said cover open over the range of movement of said cover between said one intermediate open position and said fully open position.

5. The cover of claim 1 wherein said spring includes a pair of inclined legs converging on one another and intersecting a generally V-shaped central spring portion at arcuate bends, and said spring engaging said cover along said arcuate bends.

6. The cover of claim 1 wherein said cover is hinged on a hinge axis, said cover extending on one side of said axis and having a cover mounting portion extending to the opposite side of said axis, and said spring being in engagement with said mounting portion.

7. The cover of claim 6 wherein said spring acts on said cover mounting portion to rotate said cover about said axis toward said closed position thereof over the full range of movement of said cover between its fully open and closed positions.

8. The cover of claim 6 wherein said spring acts on said cover mounting portion to rotate said cover about said axis toward said closed position thereof over the range of movement of said cover between said closed position and a partly open position, and the point of engagement between said spring and said mounting tail portion moves over center relative to said axis and said spring acts to rotate said cover in an opposite direction about said axis over the range of movement of said cover between said partly open position and said fully open position.

9. The cover of claim 8 wherein said partly open position is greater than 50° of rotation of said cover from said closed position thereof.

10. The cover of claim 1 wherein said spring has opposite sides and engages said cover between said sides for biasing said cover, and said cover having an abutment engageable with one of said spring sides to prevent further rotation of said cover and define a fully open position thereof.

11. The cover of claim 10 wherein said fully open position is at about 90° of rotation of said cover from said closed position thereof.

12. The cover of claim 1 wherein said cover has a pair of integral hinge pintles extending outwardly therefrom in opposite directions, and a support member having openings therein rotatably receiving said pintles.

13. The cover of claim 12 wherein said support member is generally U-shaped and includes a base and a pair of legs extending upwardly from said base, said pintle receiving openings being in said legs.

14. The cover of claim 13 wherein said legs include first leg portions extending upwardly from said base and being reversely bent inwardly to extend back toward said base to define second leg portions spaced inwardly from said first leg portions, and said openings being in said second leg portions.

15. The cover of claim 14 wherein said first and second leg portions have a predetermined width and are joined by reversely curved portions that have a width substantially less than said predetermined width.

16. The cover of claim 14 wherein said first and second leg portions are joined by reversely curved portions that are weakened to facilitate bending of same.

17. The cover of claim 12 wherein said pintles are substantially cylindrical and said openings have upper peripheral portions of substantially the same curvature as said pintles, said openings having lower portions that are substantially larger than the cross-sectional size of said pintles, and said spring biases said cover in a direction for engaging said pintles with said upper peripheral portions of said openings.

18. The cover of claim 12 wherein said pintles have inclined cam surfaces thereon extending inwardly from the outer ends thereof.

19. The cover of claim 1 including a support member on which said cover is hinged, said spring having a pair of inclined spring legs with curved spring leg end portions, and said curved spring leg end portions being in engagement with said support member.

20. The cover of claim 19 wherein said curved spring leg end portions have slots therein and said support member has elongated projections received in said slots for allowing sliding movement of said curved spring leg end portions along said support member in one direction parallel to said projections while preventing lateral displacement of said spring in a direction perpendicular to said one direction.

21. The cover of claim 19 wherein said support member is generally U-shaped and has a base and a pair of legs, said spring member being trapped between said cover and base in the space between said legs.

22. The cover of claim 1 including a support member on which said cover is hinged and a plate on which said support member is mounted, said support member including a base secured to said plate by a fastener, and interdigitated projections and recesses between said base and plate to prevent relative rotation between said base and plate about said fastener.

23. A hinged cover biased rotatably about a hinge axis by a leaf spring having a pair of inclined spring legs converging on one another toward a central spring portion, said legs having upwardly curved free end portions, said cover being in engagement with said spring adjacent said central spring portion, a support surface for said curved free end portions of said spring legs, and cooperating means between said support surface and said curved free end portions of said spring legs for guiding longitudinal sliding movement of said curved free end portions along said surface while preventing lateral displacement of said curved free end portions relative to said surface.

24. The cover of claim 23 wherein said cooperating means comprises longitudinal slots in said curved free end portions of said spring legs receiving elongated raised projections on said support surface.

25. The cover of claim 23 wherein said spring central portion is generally V-shaped.

26. A hinged connection for a cover having a pair of hinge pintles extending outwardly in opposite directions, said pintles having terminal ends spaced a predetermined distance apart, a support member having a pair of legs spaced-apart a distance less than said predetermined distance, said legs having openings therein for receiving said pintles, and said legs being outwardly yieldable to a spacing at least as great as said predetermined distance for allowing said pintles to snap into said openings, said pintles being cylindrical and said openings being substantially larger than said pintles, said openings having upper peripheral portions that are curved at substantially the same diameter as the diameter of said pintles, and spring means for biasing said cover in a direction for engaging said pintles with said upper peripheral portions of said openings.

27. The connection of claim 26 wherein said support member is a generally U-shaped metal member having a base and said pair of legs extend from said base, said legs including first leg portions extending from said base and being reversely curved inwardly to define second leg portions extending back toward said base in inwardly-spaced relationship to said first leg portions, and said pintle receiving openings being in said second leg portions.

28. The connection of claim 27 wherein said first and second leg portions are connected by curved portions that are weakened to facilitate bending thereof.

29. The connection of claim 26 wherein said support member is generally U-shaped and has a base from which said pair of legs extend, said base having a central rivet receiving hole, and a pair of elongated raised projections on said base on opposite sides of said hole, said projections extending longitudinally of said base between said rivet receiving hole and said legs.

30. The connection of claim 29 including holes in said base adjacent said legs.

31. The connection of claim 26 wherein said pintles have inclined cam surfaces extending inwardly from said outer ends thereof.

32. A leaf spring for biasing a hinged cover, said spring being generally M-shaped and having a pair of inclined legs that intersect a generally V-shaped central portion at arcuate bends, said legs having upwardly curved end portions, and longitudinal slots in said curved end portions.

33. A generally U-shaped support member for hingedly mounting a cover, said support member having a base and a pair of spaced-apart legs extending from said base, said legs having openings for receiving hinge pintles, said base having a central fastener hole therethrough, additional holes in said base adjacent said legs for receiving projections on a surface to which said support is mountable for preventing rotation of said base about said rivet hole, and elongated raised projections extending longitudinally of said base between said central fastener hole and said additional holes.

34. The support member of claim 33 wherein said legs include first leg portions extending from said base and being reversely curved inwardly to define second leg portions extending back toward said base in inwardly-spaced relationship to said first leg portions, and said pintle receiving openings being in said second leg portions.

35. The support member of claim 33 wherein said pintle receiving openings include upper peripheral portions that are curved on the diameter of a first circle, said openings having lower peripheral portions curved on the diameter of a second circle, and said diameter of said second circle being substantially greater than said diameter of said first circle.

36. A cover having a main body portion and a mounting portion, said mounting portion including a top wall and opposite end walls, hinge pintles integral with said end walls and extending outwardly therefrom along a pintle axis, said top wall having a rear terminal end and an inner surface, a cam member projecting downwardly from said inner surface of said top wall between said end walls in inwardly-spaced relationship to said rear terminal end of said top wall, said cam member and said main body portion of said cover being on opposite sides of said pintle axis, and said cam member extending downwardly past said pintle axis.

37. The cover of claim 36 wherein said pintles have terminal ends and upper and lower surfaces, said lower surfaces of said pintles being downwardly inclined from said outer ends toward said end walls to define pintle cam surfaces.

38. The cover of claim 36 wherein said cam member has an arcuate outer surface on the opposite side thereof from said pintle axis for cooperation with a leaf spring that rotatably biases said cover about said pintle axis, said arcuate outer surface being curved for maintaining the point of engagement between such surface and a leaf spring on the opposite side of said pintle axis from said main body portion during movement of said cover over an angle of 90° between fully open and fully closed positions.

39. The cover of claim 36 wherein said cam member has a rounded end portion for cooperation with a leaf spring that biases said cover rotatably about said pintle axis, said cam member being shaped and positioned for maintaining the point of engagement between said rounded end portion and a leaf spring on the opposite side of said pintle axis during movement of said cover through an angle of at least 50° from its fully closed position to an intermediate open position, and said cam member being shaped and positioned to maintain the point of engagement between said rounded end portion and a leaf spring on the same side of said pintle axis as said main body portion during movement of said cover from said intermediate open position to its fully open position.

* * * * *